US008689571B2

(12) United States Patent
Lafaire et al.

(10) Patent No.: US 8,689,571 B2
(45) Date of Patent: Apr. 8, 2014

(54) DRYER FOR A REFRIGERATION APPLIANCE AND A REFRIGERATION APPLIANCE INCLUDING THE DRYER

(75) Inventors: Juan Antonio Contreras Lafaire, Anderson, SC (US); David L. Hall, Piedmont, SC (US); Marcelo Candeo, Anderson, SC (US); Dennis Carl Hansen, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 560 days.

(21) Appl. No.: 12/714,105

(22) Filed: Feb. 26, 2010

(65) Prior Publication Data

US 2010/0218521 A1 Sep. 2, 2010

Related U.S. Application Data

(60) Provisional application No. 61/156,501, filed on Feb. 28, 2009.

(51) Int. Cl.

| | |
|---|---|
| ***F25B 47/00*** | (2006.01) |
| ***F25B 15/00*** | (2006.01) |
| ***F25D 17/06*** | (2006.01) |
| ***F25B 43/00*** | (2006.01) |
| ***B01D 53/02*** | (2006.01) |
| ***F16L 41/00*** | (2006.01) |

(52) U.S. Cl.

USPC ..... 62/85; 62/112; 62/474; 62/475; 62/93; 62/94; 96/134; 96/108; 137/561 A; 220/661; 220/601; 220/916

(58) Field of Classification Search

USPC ..... 62/85, 474, 475, 442, 199; 96/134, 108; 137/561 A; 220/661, 601, 916; 215/309

See application file for complete search history.

(56) References Cited

U.S. PATENT DOCUMENTS

| | | | | |
|---|---|---|---|---|
| 2,846,854 | A | 8/1958 | Galin | |
| 4,566,883 | A * | 1/1986 | Paardekooper et al. | 55/329 |
| 5,065,584 | A * | 11/1991 | Byczynski et al. | 62/81 |
| 5,575,833 | A | 11/1996 | Griffin | |
| 5,755,113 | A | 5/1998 | Ferguson et al. | |
| 5,765,391 | A * | 6/1998 | Lee et al. | 62/442 |
| 5,806,333 | A * | 9/1998 | Kim et al. | 62/353 |
| 6,138,466 | A * | 10/2000 | Lake et al. | 62/199 |
| 6,681,596 | B2 | 1/2004 | Kentner et al. | |
| 2003/0140650 | A1 * | 7/2003 | Kentner et al. | 62/474 |

(Continued)

*Primary Examiner* — Mohammad M Ali
*Assistant Examiner* — Erik Mendoza-Wilkenfel
(74) *Attorney, Agent, or Firm* — Pearne & Gordon LLP

(57) ABSTRACT

Provided is a dryer for minimizing moisture entrained within a refrigerant used to provide a cooling effect to a temperature-controlled environment, and a refrigeration appliance including such a dryer. The dryer includes a housing defining a drying chamber and a desiccant disposed within the drying chamber for removing at least a portion of the moisture from the refrigerant. A first outlet is formed in the housing adjacent a lower region of the drying chamber when the drying chamber is viewed in an operational orientation. A second outlet is also formed in the housing at an elevation vertically above the first outlet when the dryer is viewed in the operational orientation for discharging at least a portion of the refrigerant introduced into the drying chamber to be delivered to a second heat exchanger with a relatively-low internal pressure. The elevation of the second outlet relative to the first outlet promotes the discharge of the refrigerant through the first outlet instead of through the second outlet.

17 Claims, 4 Drawing Sheets

(56) References Cited

U.S. PATENT DOCUMENTS

2003/0150324 A1* 8/2003 West ..... 95/268
2004/0118139 A1* 6/2004 Kelly et al. ..... 62/199
2007/0119193 A1* 5/2007 Davis et al. ..... 62/135
2008/0011013 A1* 1/2008 Junge ..... 62/441

* cited by examiner

DRYER FOR A REFRIGERATION APPLIANCE AND A REFRIGERATION APPLIANCE INCLUDING THE DRYER

CROSS-REFERENCE TO RELATED APPLICATIONS

This application claims the benefit of U.S. Provisional Application No. 61/156,501, filed Feb. 28, 2009, which is incorporated in its entirety herein by reference.

BACKGROUND OF THE INVENTION

1. Field of the Invention

This application relates generally to a dryer for minimizing moisture entrained within a refrigerant circulated through a refrigeration cycle and, more specifically to a dryer including a plurality of outputs arranged to provide a predetermined preference of the refrigerant to be discharged through each of the outputs and a refrigeration appliance including such a dryer.

2. Description of Related Art

Refrigeration appliances include a refrigeration system that uses a refrigerant to provide a cooling effect to a temperature-controlled environment within a compartment of the refrigeration appliance. During assembly the refrigeration system is sealed but moisture from the ambient assembly environment is absorbed by, and becomes entrained within the refrigerant. Since portions of the refrigeration system, including the refrigerant, experience temperatures below the freezing temperature of water the moisture entrained within the refrigerant could potentially freeze and obstruct the flow of refrigerant through the refrigeration system.

To minimize the amount of moisture entrained within the refrigerant, a dryer storing a desiccant is included within the refrigeration system. Refrigerant introduced into the dryer is exposed to a desiccant and at least a portion of the moisture from the refrigerant is absorbed by the desiccant. Much of the moisture is removed from the refrigerant the first couple of times the refrigerant passes through the dryer, but since the refrigeration system is sealed during assembly the dryer can not be removed once it has outlived its useful life. Thus, the dryer should not adversely affect operation of the refrigeration system during normal operation of the refrigeration appliance.

Accordingly, there is a need in the art for a dryer to be included in a refrigeration appliance for minimizing a moisture content of a refrigerant used by a refrigeration system of the refrigeration appliance to provide a cooling effect and a refrigeration appliance including such a dryer. The dryer can discharge the refrigerant through a plurality of outlets with a predetermined preference of the refrigerant to discharge the refrigerant through each of the outlets.

BRIEF SUMMARY

According to one aspect, the subject application involves a dryer for minimizing moisture entrained within a refrigerant used to provide a cooling effect to a temperature-controlled environment. The dryer includes a housing defining a drying chamber and a desiccant disposed within the drying chamber for removing at least a portion of the moisture from the refrigerant introduced into the drying chamber. An inlet is formed in the housing, the inlet being adapted to cooperate with a feed line supplying the refrigerant in a substantially liquid state to be introduced into the drying chamber. A first outlet is formed in the housing adjacent a lower region of the drying chamber when the drying chamber is viewed in an operational orientation. At least a portion of the refrigerant introduced into the drying chamber and exposed to the desiccant is to be discharged from the drying chamber through the first outlet and delivered to a first heat exchanger with a relatively-high internal pressure. A second outlet is also formed in the housing at an elevation vertically above the first outlet when the dryer is viewed in the operational orientation for discharging at least a portion of the refrigerant introduced into the drying chamber to be delivered to a second heat exchanger with a relatively-low internal pressure. The elevation of the second outlet relative to the first outlet promotes the discharge of the refrigerant through the first outlet to be delivered to the heat exchanger with the relatively-high internal pressure instead of through the second outlet.

According to another aspect, the subject application involves a refrigeration appliance that includes an insulated compartment for storing food items in a temperature-controlled environment, a first evaporator, and a second evaporator in thermal communication with the insulated compartment to provide a cooling effect within the insulated compartment. An internal operating pressure of the first evaporator is greater than an internal operating pressure of the second evaporator. A compressor is provided for elevating a pressure of a refrigerant in a substantially-gaseous phase, and a condenser at least partially condenses the compressed refrigerant into a liquid phase. A dryer is provided for at least partially removing moisture entrained within the refrigerant. The dryer includes a drying chamber and a desiccant disposed within the drying chamber for removing at least a portion of the moisture from the refrigerant exposed to the desiccant. An inlet is formed in the drying chamber for introducing the refrigerant in a substantially-liquid phase into the drying chamber, and a first outlet is formed in the drying chamber and is in communication with a conduit for transporting the refrigerant from the dryer to be delivered to the first evaporator. A second outlet is also formed in the drying chamber and is in communication with another conduit for transporting the refrigerant from the dryer to be delivered to the second evaporator. An arrangement of the second outlet relative to the first outlet establishes a preference of the refrigerant to be discharged through the first outlet to be delivered to the first evaporator with the internal operating pressure that is greater than the internal operating pressure of the second evaporator. A valve provided to the refrigeration appliance is operable to selectively interrupt delivery of the refrigerant to the first evaporator.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
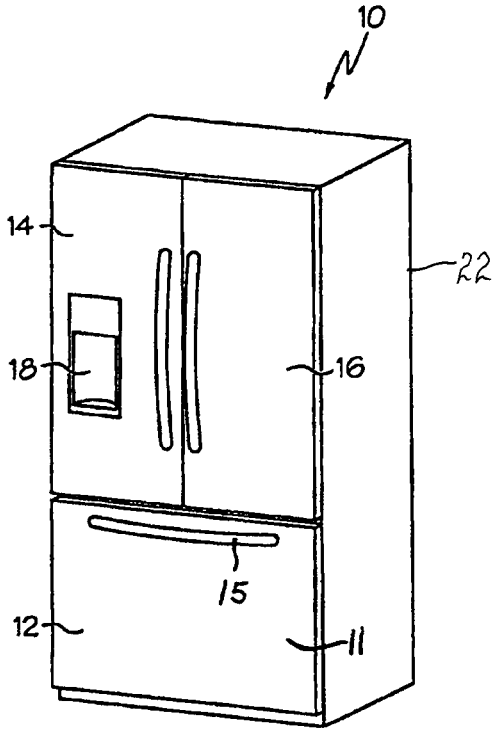
FIG. 1 is a perspective view of a refrigeration appliance in accordance with an aspect of the invention.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

FIG. 1 shows an illustrated embodiment of a refrigeration appliance 10. The refrigeration appliance 10 shown in FIG. 1 is configured as a so-called bottom-mount refrigerator. A pair of French doors 14, 16 restricting access to an insulated fresh food compartment 20 (FIG. 2) are pivotally connected to a cabinet 22 by hinges at opposite lateral sides of the cabinet 22. A pivotal center mullion 28 (FIG. 2) is coupled to the door 16 to cooperate with a seal 30 provided to the other door 14. When the doors 14, 16 are closed the seal 30 cooperates with the center mullion 28 to minimize the amount of cold air escaping the fresh food compartment 20 between the doors 14, 16. A dispenser 18 can optionally be provided to the door 14 to dispense it at least one of water and ice from the refrigeration appliance 10 without requiring either of the doors 14, 16 to be opened. Ice dispensed through the dispenser 18 can be made by, and delivered from an ice maker 26 (FIG. 2) disposed within the fresh food compartment 20 of the refrigeration appliance 10. Likewise, water dispensed through the dispenser 18 can optionally be filtered by a water filter (not shown) disposed within the fresh food compartment 20 of the refrigeration appliance 10.

A freezer door 12 is coupled to a wire basket disposed within an insulated freezer compartment 24 and is arranged vertically beneath the fresh food compartment 20. A handle 15 is provided to an externally-exposed side of the freezer door 12 to be grasped by a user and pulled outwardly to at least partially extract the freezer basket from within the freezer compartment 24, thereby making the contents of the freezer basket accessible. The freezer basket can be slidably mounted within the freezer compartment 24 by ball-bearing drawer slides such as those manufactured by Accuride International Inc., based in Santa Fe Springs, Calif. Pulling the handle 15 will move the freezer door 12 outwardly away from the freezer compartment 24 and cause the freezer basket to travel along a track defined by the slide rails to at least partially expose the contents of the freezer basket to a user standing in front of the refrigeration appliance 10.

Figure 2:
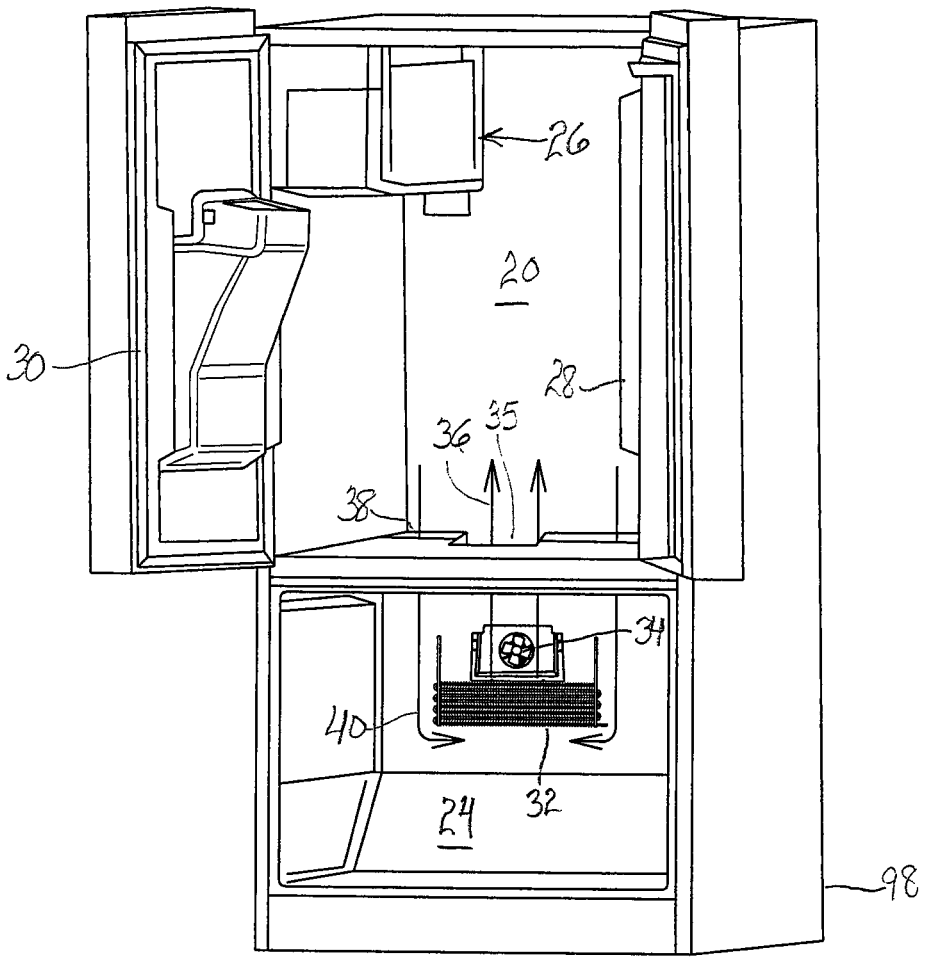
FIG. 2 is a perspective view into an interior of a fresh-food compartment and a freezer compartment of the refrigeration appliance shown in FIG. 1.

As shown in FIG. 2, a system evaporator 32 is in thermal communication with the interior of the freezer compartment 24. Refrigerant flowing through the system evaporator 32 as described below cools air being blown by a circulation fan 34 to be distributed to the fresh food compartment 20 and the freezer compartment 24. The cool air is blown upward through an air duct 35 formed in the insulation between the fresh food and freezer compartments 20, 24 in the direction of arrows 36 to provide a cooling effect to the fresh food compartment 20. Air circulated through the fresh food compartment 20 to be returned to the freezer compartment 24 travels through a pair of return ducts 38 also extending between the fresh food and freezer compartments 20, 24 in the direction of arrows 40. The cool air from the system evaporator 32 is circulated to maintain the temperature within the fresh food compartment 22 at temperature that is above freezing, but generally less than about 45° F. The cool air can additionally, or alternatively maintain a temperature within the freezer compartment 24 to within a close tolerance of a target temperature that is below zero degrees Centigrade.

Figure 3:
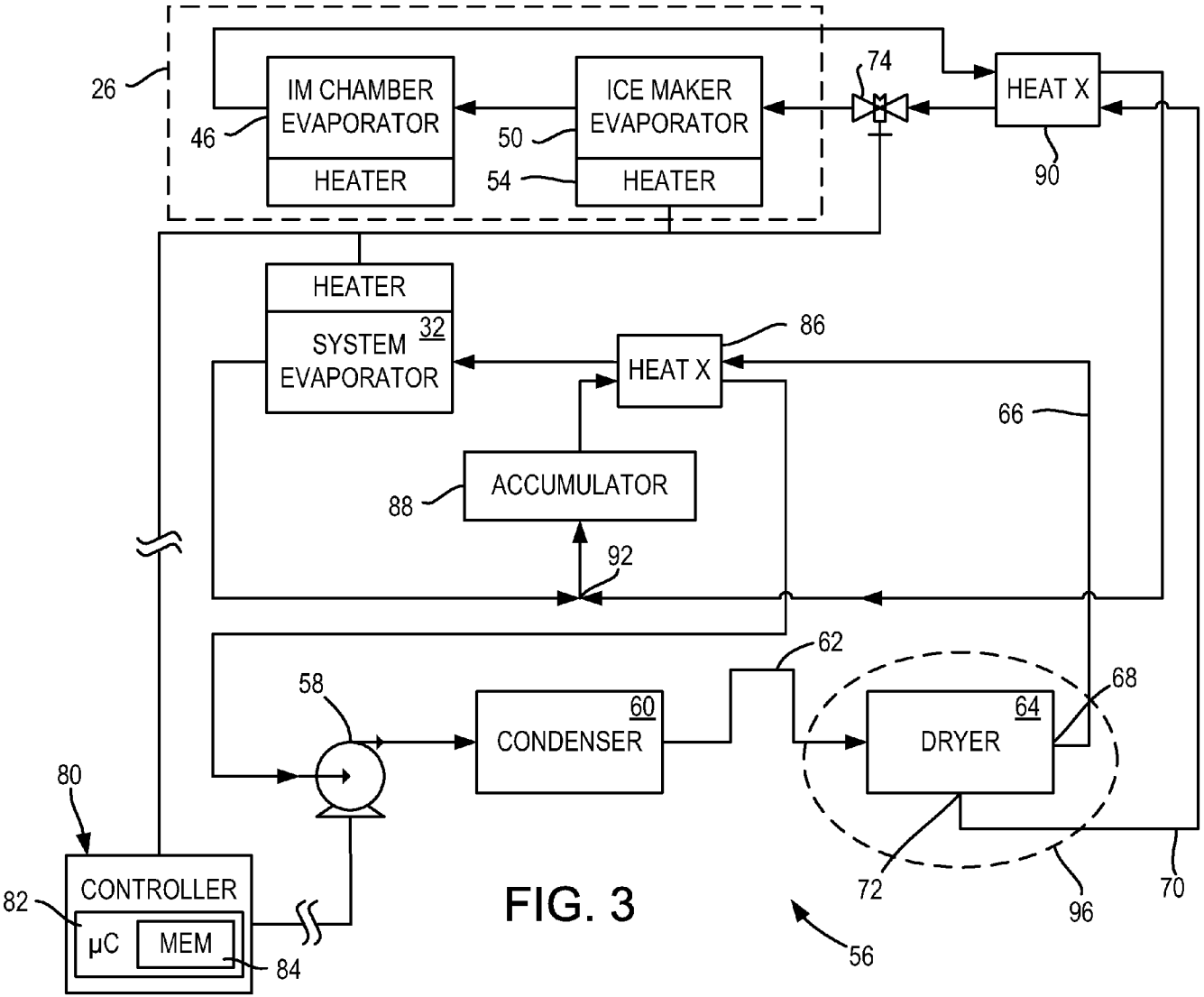
FIG. 3 is an illustrative embodiment of a refrigeration cycle that can be used to provide cooling effect to a compartment provided to a refrigeration appliance and an ice maker disposed within the compartment of the refrigeration appliance.

As shown in FIG. 3, the ice maker 26 includes a chamber evaporator 46 for cooling air to be introduced to an ice bucket for storing ice made by the ice maker 26 that is waiting to be dispensed. According to an embodiment of the ice maker 26, the ice maker 26 also includes an ice making evaporator 50 in series with the chamber evaporator 46 to provide a cooling effect for freezing water into ice pieces. For example, the ice making evaporator 50 can cool an exposed surface of a plurality of freezing fingers (not shown) that is to be submerged within water. As the temperature of the external surface of the fingers 52 falls to a sub-freezing temperature the water in which the portion of the freezing fingers is submerged is frozen to the freezing fingers as the ice pieces to be harvested. The exterior surface of the fingers 52 can be warmed by a heater 350 once the ice pieces are fully frozen, and the ice pieces frozen to the fingers 52 allowed to fall into the ice bucket.

Although the refrigeration appliance 10 has been described above is including both a fresh food compartment 20 and a freezer compartment 24, the refrigeration appliance 10 described herein is not so limited. Instead, alternate environments can include only a fresh food compartment 20, or only a freezer compartment 24, for example. Further, the illustrative examples discussed herein include an icemaker 26 that utilizes freezing fingers to which the ice pieces are to freeze. However, alternate embodiments can include any icemaker 26 capable of freezing water into individual ice pieces, such as by freezing water in a tray through convection. The refrigeration appliance 10 discussed herein can be configured in any desired manner, including a plurality of evaporators to which refrigerant is supplied to provide their respective cooling effects. For the sake of brevity the illustrative example including the chamber evaporator 46 in series with the ice making evaporator 50 and a separately supplied system evaporator 32 will continue to be discussed in detail below.

In addition to the evaporators 32, 46, 50 discussed above, the refrigeration circuit 56 shown in FIG. 3 also includes a variable-speed compressor 58 for compressing gaseous refrigerant to a high-pressure refrigerant gas. The compressor 58 can optionally be infinitely variable, or can be varied between a plurality of predetermined, discrete operational speeds depending on the demand for cooling. The high-pressure refrigerant gas from the compressor 58 can be conveyed through a suitable conduit such as copper tubing to a condenser 60, which cools the high-pressure refrigerant gas and causes it to at least partially condense into a liquid refrigerant. From the condenser 60, the liquid refrigerant can optionally be transported through an optional eliminator tube 62 that is embedded within a portion of the center mullion 28 (FIG. 2). The liquid refrigerant flowing through the eliminator tube 62 elevates the temperature of an external surface of the center mullion 28 to minimize the condensation of moisture from an ambient environment of the refrigeration appliance 10 thereon.

Downstream of the eliminator tube 62, or downstream of the condenser 60 in the absence of the eliminator tube 28, a dryer 64 is installed to minimize the moisture entrained within the refrigerant circulating through the refrigeration circuit 56. The dryer 64 includes a hygroscopic desiccant that absorbs water from the liquid refrigerant. The desiccant can be any suitable material for minimizing the moisture content of the refrigerant such as a 100% molecular sieve desiccant beads, for example. The water content of the refrigerant is minimized the first few times the refrigerant is circulated through the refrigeration circuit 56, and accordingly the dryer 64, the dryer 64 remains in the refrigeration circuit 56 to avoid exposing the refrigerant to the ambient environment from where it can retain additional moisture.

A system capillary tube 66 is in fluid communication with the dryer 64 to transport refrigerant discharged through an outlet 68 to be delivered to the system evaporator 32. Likewise, an ice maker capillary tube 70 is also in fluid communication with the dryer 64 to transport refrigerant discharged through an outlet 72. The ice maker capillary tube 70 transports refrigerant to be delivered to at least an ice making evaporator 50 provided to the ice maker 20 for freezing water into the ice pieces, and optionally to a chamber evaporator 46 provided to the ice maker 20 for controlling a storage temperature to which ice pieces are exposed when stored in the ice bin 35.

An optional metering valve 74 can be disposed between the ice maker evaporator and the outlet 72 of the dryer 64. The metering valve 74 is configured to control the flow of refrigerant entering the ice making evaporator 50 and the optional chamber evaporator 46. The metering valve 74 allows the flow of refrigerant to the portion of the refrigeration circuit 56 including the ice making evaporator 50 (this portion being referred to hereinafter as the "Ice Maker Path") to be regulated independently of the flow of refrigerant to the portion of the refrigeration circuit 56 including the system evaporator 32 (this portion being referred to hereinafter as the "System Path") for controlling the temperature within at least one of the freezer compartment 24 and the fresh food compartment 20. Thus, the flow of refrigerant to the ice making evaporator 50, and optionally to the chamber evaporator 46 can be discontinued to terminate cooling of the freezing fingers and optionally the cooling effect provided by the chamber evaporator 46 even though the compressor 58 is operational and refrigerant is being delivered to the system evaporator 32. The delivery of refrigerant to the system evaporator 32 can be controlled by controlling operation of the compressor 58. Refrigerant is delivered to the system evaporator 32 when the compressor 58 is operational and is not delivered to the system evaporator 32 when the compressor 58 is off.

Due at least in part to the different operating temperatures of the system evaporator 32, ice making evaporator 50, and chamber evaporator 46, the pressure drop experienced by the refrigerant across the Ice Maker Path, or at least the pressure of the refrigerant returning from the Ice Maker Path can be different than the corresponding pressures from the System Path. For example, the pressure of the refrigerant returning from the Ice Maker Path may be greater than the pressure of the refrigerant returning from the System Path at a point 92 where the refrigerant returning from each path is combined. To minimize the effect of the higher-pressure refrigerant returning from the Ice Maker Path on the performance of the system evaporator 32 (i.e., by increasing the output pressure from the system evaporator 32 and thereby reducing the pressure drop across the system evaporator 32), an evaporator pressure regulator can optionally be disposed between the Ice Maker Path and the point 92 where the refrigerants returning from each path are combined. The optional evaporator pressure regulator can adjust the pressure of the refrigerant returning from the Ice Maker Path to approximately match the pressure of the refrigerant returning from the System Path.

With reference to FIG. 2, it can also be seen that the system evaporator 32 is disposed vertically lower on the refrigeration appliance 10 than the ice maker 26 in which the ice making evaporator 50 and optional chamber evaporator 46 is located. The relative difference between the height of the system evaporator 32 and the evaporator(s) 46, 50 provided to the ice maker 26 on the refrigeration appliance 10 can also possibly affect a preference of refrigerant leaving the dryer 64 for the system evaporator 32 over the evaporator(s) 46, 50 provided to the ice maker 26. A lower pressure may be required to supply refrigerant from the dryer 64 to the system evaporator 32 than is required to supply refrigerant from the dryer 64 to the ice maker 26 if the outlets 68, 72 were at approximately the same location on the dryer 64, and all other factors being equal. Further, the system evaporator 32 typically operates at a lower temperature (i.e., lower energy level) than the ice making evaporator 50 and the chamber evaporator 46. Thus, if the system outlet 68 and the ice maker outlet 72 were located at approximately the same location along a housing 100 (FIG. 4) of the dryer 64 the refrigerant exiting the dryer 64 would exhibit a substantial preference for the System Path as the path of least resistance, and the Ice Maker Path would be supplied with relatively little refrigerant. Under such circumstances, even when the metering valve 74 is open the ice maker 26 would be substantially deprived of the required refrigerant to perform ice making operations.

Figure 4:
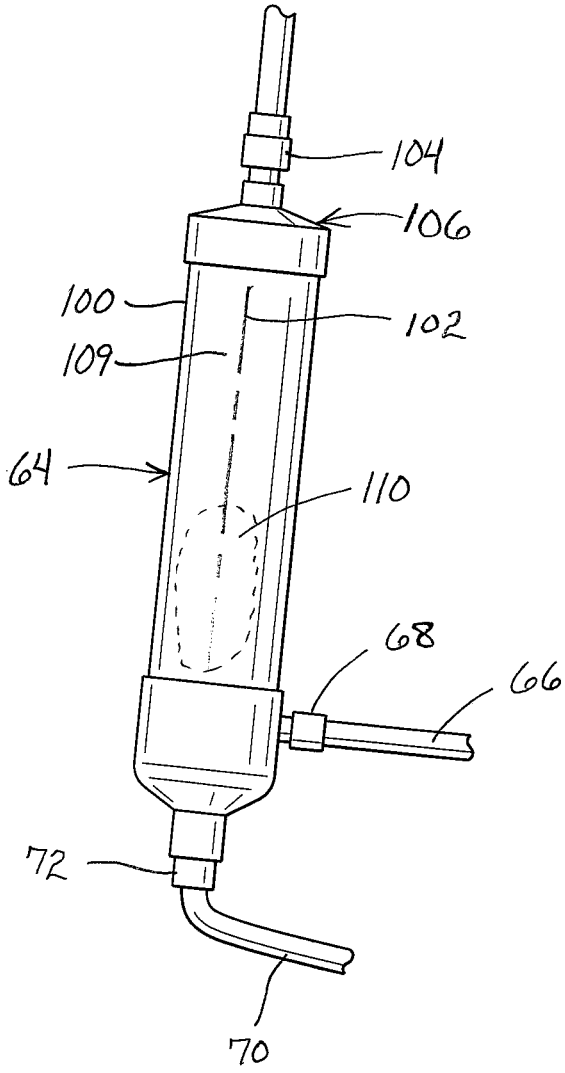
FIG. 4 is a side view of a dryer including a plurality of outlets in communication with conduits for supplying a refrigerant to a plurality of different evaporators according to an aspect of the invention.

To minimize the effect of the different operating conditions within the evaporators 32, 46, 50 on the preference of the refrigerant being discharged from the dryer 64, the plurality of outlets 68, 72 from the dryer 64 can optionally be located at different positions relative to each other to ensure refrigerant is supplied to both the System Path and the Ice Maker Path in the presence of different operating conditions. For example, an embodiment of the dryer 64 in communication with the system capillary tube 66 and the ice maker capillary tube 70 (the portion of the refrigeration circuit 56 within a circle 96 in FIG. 3) is shown in FIG. 4. The dryer 64 is shown in FIG. 4 in its operational orientation, i.e., with its longitudinal axis 102 in a substantially vertical orientation, and can be installed on a refrigeration appliance 10 in this operational orientation. As shown, the dryer includes an elongated, generally cylindrical housing 100 made from a metal or metal alloy such as copper, or alloy including copper, or other suitable metal and extending along a longitudinal axis 102 that is substantially vertically oriented when the dryer 64 is in the operational orientation. An inlet 104 is formed adjacent to an upper region 106 of the housing 100, an ice maker outlet 72 is formed adjacent to a lowermost region 108 of the housing 100, and a system outlet 68 extends in a radially-outward direction from a side of the housing 100 at an elevation along the longitudinal axis 102 between the inlet 104 and the ice maker outlet 72 when the dryer 64 is viewed in the operational orientation. The granular desiccant 110 (shown as broken lines in FIG. 4) can be disposed within a drying chamber 109 defined by the housing 100 to be exposed to refrigerant as it passes through the drying chamber 109 to absorb at least a portion of the moisture entrained within the refrigerant.

The system outlet 68 is adapted to communicate with the system capillary tube 66 for outputting refrigerant to the System Path. Similarly, the ice maker outlet 72 is adapted to communicate with the ice maker capillary tube 70 for outputting refrigerant to the Ice Maker Path. Such a configuration of the system outlet 68 and the ice maker outlet 72 relative to the housing 100 of the dryer 64 is referred to herein as an "F-joint" because the housing 100, the system outlet 68 and the ice maker outlet 72 collectively form a structure having the general appearance of an upside down "F".

The F-joint configuration of the dryer 64 and the outlets 68, 72 in communication with their respective capillary tubes 66, 70 promotes a substantially balanced preference of the refrigerant exiting the dryer 64 to be delivered to each of the System Path and the Ice Maker Path. For example, refrigerant can be discharged from the dryer 64 through the ice maker outlet 72 in a direction that is generally parallel with, and assisted by a force of gravity to promote the discharge of refrigerant leaving the dryer 64 through the ice maker outlet 72. However, according to alternate embodiments the dryer 64 can include any suitable shape and arrangement. It is sufficient if the system outlet 68 and the ice maker outlet 72 are provided at different locations on the dryer 64 to achieve a substantially balanced preference of the refrigerant to be discharged from both the system outlet 68 and the ice maker outlet 72.

A liquid level of the refrigerant within the dryer 64 falls to a level between the system and ice maker outlets 68, 72 when the dryer 64 is viewed in the operational orientation as a result of the refrigerant being discharged from the dryer 64 at a faster rate than the refrigerant is introduced thereto. For example, during ice making, the refrigerant is discharged through both the system outlet 68 and the ice maker outlet 72, and the liquid level of the refrigerant in the dryer 64 falls to a level that is between the two outlets 68, 72. When this occurs, the delivery of refrigerant to the system evaporator 32 can be temporarily disrupted while the metering valve 74 is open and ice is being made by the ice maker 26. When ice making (or at least the freezing of the ice pieces) is complete, the metering valve 74 can be closed, allowing the liquid level of the refrigerant to once again rise at least as high as the system outlet 68 while the compressor 58 is operational. The liquid level of refrigerant will typically exceed the height of the system outlet 68 under such conditions such that liquid refrigerant can once again be discharged through the system outlet 68, but not the ice maker outlet 72. The elevation of the system outlet 68 is vertically above a lowermost liquid level the refrigerant reaches within the drying chamber 109 while the refrigerant is being discharged. Similarly, the elevation of the system outlet 68 is vertically below an uppermost liquid level reached by the refrigerant within the drying chamber 109 while the refrigerant is not being discharged from the ice maker outlet 72 and/or system outlet 68.

The steps taken to control operation of the refrigeration circuit 56 discussed herein can optionally be executed by a controller 80 operatively connected to portions of the refrigeration circuit 56 to receive and/or transmit electronic control signals to those portions. For example, temperature sensors can optionally be wired to transmit signals indicative of sensed temperatures to the controller 80. According to alternate embodiment, any type of sensors such as position sensors, timers, etc. . . . can transmit feedback to the controller 80 for controlling operation of the refrigeration appliance 10. A microprocessor 82 provided to the controller 80 executing computer-executable instructions stored in a computer-readable memory 84 embedded in the microprocessor 82 can initiate transmission of an appropriate control signal from the controller 80 to cause an adjustment of the metering valve 74, compressor 58, or any other portion of the refrigeration circuit 56 to carry out the appropriate control operation.

In operation, the compressor 58 compresses the substantially-gaseous refrigerant to a high pressure, high-temperature refrigerant gas. As this refrigerant travels through the condenser 96 it cools and condenses into a high-pressure liquid refrigerant. The liquid refrigerant can then optionally flow through the eliminator tube 62 and into the dryer 64, which minimizes moisture entrained within the refrigerant. If ice is to be made by the ice maker 26, the metering valve 74 is opened by the controller 80, allowing refrigerant to be discharged through the ice maker outlet 72 of the dryer 64 in addition to the system outlet 68. If the liquid level within the dryer 64 falls below the system outlet 68 the refrigerant will be discharged through only the ice making outlet 72 until the liquid level of the refrigerant rises at least to the level of the system outlet 68, at which time the refrigerant can once again be discharged through the system outlet 68. When ice is not being made, the metering valve 74 can be closed by the controller 80. If the refrigeration cycle 56 is to provide a cooling effect to at least one of the fresh food and freezer compartments 20, 24, the compressor 58 is activated by the controller 80 and the refrigerant is discharged from the dryer 64 through the system outlet 68 to be delivered to the system evaporator 32, but not through the ice maker outlet 72 until the metering valve 74 is opened.

The refrigerant conveyed by the system capillary tube 66 transfers some of its thermal energy to refrigerant returning from the System Path via the system heat exchanger 86 and subsequently enters the system evaporator 32. In the system evaporator 32, the refrigerant expands and at least partially evaporates into a gas. During this phase change, the latent heat of vaporization is extracted from air being directed over fins and coils of the system evaporator 32, thereby cooling the air to be directed by the circulation fan 34 (FIG. 2) into at least one of the freezer compartment 24 and the fresh food compartment 20. This cooled air brings the temperature within the respective compartment to within an acceptable tolerance of a target temperature. From the system evaporator 32, the substantially gaseous refrigerant is returned to the liquid accumulator 88 where remaining liquid is allowed to evaporate into gaseous refrigerant. The substantially gaseous refrigerant from the liquid accumulator 88 can receive thermal energy from the refrigerant being delivered to the system evaporator 32 via the system heat exchanger 86 and then returned substantially in the gaseous phase to the compressor 58.

When ice is to be produced by the ice maker 20, the controller 80 can at least partially open the metering valve 74. Refrigerant from the dryer 64 delivered to the Ice Maker Path through capillary tube 70 provides thermal energy via ice maker heat exchanger 90 to the refrigerant returning from the Ice Maker Path. After passing through the metering valve 74 the refrigerant enters the ice making evaporator 50 where it expands and at least partially evaporates into a gas. The latent heat of vaporization required to accomplish the phase change is drawn from the ambient environment of the ice maker evaporator 50, thereby lowering the temperature of an external surface of the ice maker evaporator 50 to a temperature that is below 0° C. Water exposed to the external surface of the ice making evaporator 50 is frozen to form the ice pieces. The refrigerant exiting the ice making evaporator 50 enters chamber evaporator 46, where it further expands and additional liquid refrigerant is evaporated into a gas to cool the external surface of the chamber evaporator 46. An optional fan or other air mover can direct an airflow over the chamber evaporator 46 to cool the ambient environment of ice pieces stored in the ice bin 35 to minimize melting of those ice pieces.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A dryer for minimizing moisture entrained within a refrigerant used to provide a cooling effect to a temperature-controlled environment, the dryer comprising:

a cylindrical housing defining a drying chamber;

a desiccant disposed within the drying chamber for removing at least a portion of the moisture from the refrigerant introduced into the drying chamber;

an inlet formed in the housing, said inlet being adapted to cooperate with a feed line supplying the refrigerant in a substantially liquid state to be introduced into the drying chamber;

a first outlet formed in the housing adjacent a lower region of the drying chamber when the drying chamber is viewed in an operational orientation, wherein the first outlet is adapted to be coupled to a capillary tube and form a conduit through which at least a portion of the refrigerant introduced into the drying chamber and exposed to the desiccant is discharged from the drying chamber to be delivered to a first heat exchanger for providing a cooling effect; and a second outlet extending radially outward from a wall of the housing at an elevation vertically above a lowermost liquid level of the refrigerant to be achieved within the drying chamber while the refrigerant is being discharged through the first outlet when the dryer is viewed in the operational orientation, the second outlet being adapted to be coupled to another capillary tube to form another conduit through which at least a portion of the refrigerant introduced into the drying chamber and exposed to the desiccant is to be discharged through the another capillary tube and delivered to a second heat exchanger, that is different than the first heat exchanger, for providing another cooling effect, wherein a resistance to delivery of the refrigerant to the first heat exchanger is greater than a resistance to delivery of the refrigerant to the second heat exchanger, and the elevation of the second outlet relative to the first outlet balances a discharge of the refrigerant through the first and second outlets.

2. The dryer according to claim 1, wherein each of the first and second outlets is adapted to cooperate with a capillary tube for transporting the refrigerant from the dryer to the first and second heat exchangers.

3. The dryer according to claim 1, wherein the drying chamber comprises a housing formed primarily from a metal or a metal alloy comprising copper.

4. The dryer according to claim 1, wherein the housing comprises an elongated, generally cylindrical shape extending along a longitudinal axis that is substantially vertically oriented when the dryer is in the operational orientation, and further wherein the inlet is formed adjacent to an upper region of the housing, the first outlet is formed adjacent to a lower region of the housing, and the second outlet is formed in the housing at an elevation between the inlet and the first outlet when the dryer is viewed in the operational orientation.

5. The dryer according to claim 1, wherein the elevation of the second outlet is vertically below an uppermost liquid level reached by the refrigerant within the drying chamber while the refrigerant is not being discharged from the first outlet.

6. A refrigeration appliance comprising:

an insulated compartment for storing food items in a temperature-controlled environment;

a first evaporator;

a second evaporator in thermal communication with the insulated compartment, wherein the second evaporator provides a cooling effect within the insulated compartment, wherein a resistance to delivery of a refrigerant to the first evaporator is greater than a resistance to delivery of the refrigerant to the second evaporator;

a compressor for elevating a pressure of the refrigerant in a substantially-gaseous phase;

a condenser for at least partially condensing the refrigerant into a liquid phase;

a dryer for at least partially removing moisture entrained within the refrigerant, the dryer comprising:

a drying chamber, a desiccant disposed within the drying chamber that removes at least a portion of the moisture from the refrigerant exposed to the desiccant;

an inlet through which the refrigerant is introduced in a substantially-liquid phase into the drying chamber, a first outlet formed in the housing adjacent a lower region of the drying chamber extends in a first direction from the drying chamber in fluid communication with a conduit for transporting the refrigerant along a first fluid flow path from the dryer to be delivered to the first evaporator, and a second outlet extending radially outward from a wall of the housing at an elevation vertically above a lowermost liquid level of the refrigerant to be achieved within the drying chamber while the refrigerant is being discharged through the first outlet in fluid communication with a conduit for transporting the refrigerant along another fluid flow path, that is independent from the first fluid flow path, from the dryer to be delivered to the second evaporator, wherein the second outlet is arranged at an elevation vertically above the first outlet with the drying chamber in an operational orientation establishing a preference of the refrigerant to be discharged through the first outlet and delivered to the first evaporator, balancing a discharge of the refrigerant through the first and second outlets; and a valve that is operable to selectively interrupt delivery of the refrigerant to the first evaporator.

7. The refrigeration appliance according to claim 6, wherein the second outlet is disposed at an elevation vertically above an elevation of the first outlet.

8. The refrigeration appliance according to claim 7, wherein the elevation of the second outlet is vertically above a lowermost liquid level reached by the refrigerant within the drying chamber while the refrigerant is being discharged through the first outlet.

9. The refrigeration appliance according to claim 8, wherein the elevation of the second outlet is vertically below an uppermost liquid level reached by the refrigerant within the drying chamber while the refrigerant is not being discharged from the first outlet.

10. The refrigeration appliance according to claim 7, wherein the dryer comprises a housing defining the drying chamber, the housing comprising an elongated, generally cylindrical shape extending along a longitudinal axis that is substantially vertically oriented installed on the refrigeration appliance, and further wherein the inlet is formed adjacent to an upper region of the housing, the first outlet is formed adjacent to a lower region of the housing, and the second outlet is formed in the housing at an elevation between the inlet and the first outlet.

11. The refrigeration appliance according to claim 7, wherein the first evaporator is in thermal communication with an ice maker provided to the refrigeration appliance and the second evaporator is in thermal communication with the insulated compartment for maintaining a temperature within the insulated compartment to 45° F. or less.

12. The refrigeration appliance according to claim 6, wherein operation of the second evaporator maintains the temperature within the insulated compartment to 45° F. or less.

13. The refrigeration appliance according to claim 12, wherein the insulated compartment is a fresh food compartment and an ice maker is disposed within the fresh food compartment.

14. The refrigeration appliance according to claim 6 further comprising a freezer compartment located at an elevation vertically below an elevation of the insulated compartment, wherein the insulated compartment is a fresh food compartment.

15. A method of minimizing moisture entrained within a refrigerant to remove heat from an insulated compartment of a refrigeration appliance comprising at least a first evaporator, providing a first cooling effect, a second evaporator providing a second cooling effect, and a dryer storing a desiccant that at least partially removes the moisture from the refrigerant to be supplied to the first and second evaporators, the method comprising:

receiving a request that the refrigerant is to be delivered to the first evaporator;

in response to receiving the request, operating a fluid flow restrictor allowing discharging of the refrigerant through a first outlet of the dryer, discharging to the first evaporator, wherein operating the fluid flow restrictor results in a liquid level of the refrigerant within the dryer falling to a level that is vertically beneath a second outlet of the dryer, discharging refrigerant to the second evaporator, wherein said operating the fluid flow restrictor overcomes a preference of the refrigerant to be discharged through the second outlet relative to the first outlet and establishes a balanced discharge of the refrigerant through the first and second outlets; and operating the fluid flow restrictor to interfere with delivery of the refrigerant to the first evaporator through the first outlet when the cooling effect of the first evaporator is to be interrupted, wherein operating the fluid flow restrictor to interfere with delivery of the refrigerant results in the liquid level of the refrigerant within the dryer to rise to a level that is greater than or equal to an elevation of the second outlet of the dryer.

16. The method according to claim 15, wherein an internal operating pressure within the first evaporator is greater than an internal operating pressure within the second evaporator, and when the liquid level of the refrigerant within the dryer is greater than or equal to the elevation of the second outlet of the dryer and the refrigerant is being delivered to the first evaporator, the refrigerant exhibits a preference to being discharged through the second outlet and delivered to the second evaporator.

17. The method according to claim 16, wherein the first evaporator is operable to provide a cooling effect to an ice maker disposed within a fresh food compartment of the refrigeration appliance and the second evaporator is operable to provide a cooling effect to the insulated compartment of the refrigeration appliance.

* * * * *